US012134162B2

(12) United States Patent
Sung

(10) Patent No.: US 12,134,162 B2
(45) Date of Patent: Nov. 5, 2024

(54) WAFER POLISHING HEAD, METHOD FOR MANUFACTURING WAFER POLISHING HEAD, AND WAFER POLISHING APPARATUS COMPRISING SAME

(71) Applicant: SK SILTRON CO., LTD., Gyeongsangbuk-do (KR)

(72) Inventor: Jae Chel Sung, Gyeongsangbuk-do (KR)

(73) Assignee: SK SILTRON CO., LTD., Gyeongsangbuk-Do (KR)

( * ) Notice: Subject to any disclaimer, the term of this patent is extended or adjusted under 35 U.S.C. 154(b) by 371 days.

(21) Appl. No.: 17/765,899

(22) PCT Filed: Oct. 23, 2019

(86) PCT No.: PCT/KR2019/013927

§ 371 (c)(1),
(2) Date: Apr. 27, 2022

(87) PCT Pub. No.: WO2021/066242

PCT Pub. Date: Apr. 8, 2021

(65) Prior Publication Data

US 2022/0379429 A1 Dec. 1, 2022

(30) Foreign Application Priority Data

Oct. 1, 2019 (KR) ..... 10-2019-0121299

(51) Int. Cl.
*B24B 37/20* (2012.01)

(52) U.S. Cl.
CPC ..... *B24B 37/20* (2013.01)

(58) Field of Classification Search
CPC ..... B24B 37/30; B24B 37/32; B24B 37/27
See application file for complete search history.

(56) References Cited

U.S. PATENT DOCUMENTS 6,277,008 B1 * 8/2001 Masuta ..... B24B 37/32 451/286
6,835,125 B1 12/2004 Tseng et al.
(Continued)

FOREIGN PATENT DOCUMENTS

CN 2712547 7/2005
CN 201776703 3/2011
(Continued)

OTHER PUBLICATIONS

Chinese Office Action dated Aug. 5, 2023 issued in Application No. 201980102330.2.
(Continued)

*Primary Examiner* — Joel D Crandall
(74) *Attorney, Agent, or Firm* — KED & ASSOCIATES, LLP

(57) ABSTRACT

The present invention provides a method for manufacturing a wafer polishing head, the method comprising the steps of: coupling a guide ring consisting of a plurality of layers to the edge of a base substrate; rounding the edge of the guide ring; forming a first coating layer on the rounded surface of the guide ring through coating; fixing a rubber chuck to the base substrate; and forming a second coating layer on the outer circumferential surfaces of an adhesive and an adhesive material through coating, from the rubber chuck to the first coating layer.

16 Claims, 9 Drawing Sheets

(56) References Cited

U.S. PATENT DOCUMENTS

| | | | | |
|---|---|---|---|---|
| 2001/0039167 | A1 | 11/2001 | Saguchi et al. | |
| 2011/0081841 | A1* | 4/2011 | Sung | B24B 37/32 451/364 |
| 2015/0099437 | A1* | 4/2015 | Martin | B24B 37/32 451/364 |
| 2016/0101502 | A1 | 4/2016 | Albrecht et al. | |

FOREIGN PATENT DOCUMENTS

| | | |
|---|---|---|
| JP | 2001-287157 | 10/2001 |
| JP | 2004-327779 | 11/2004 |
| JP | 2010-244774 | 10/2010 |
| JP | 2013-507764 | 3/2013 |
| JP | 2018-069352 | 5/2018 |
| KR | 10-2011-0037662 | 4/2011 |
| KR | 10-2011-0037848 | 4/2011 |

OTHER PUBLICATIONS

European Search Report dated Sep. 25, 2023 issued in Application No. 19947571.6.
Japanese Office Action dated May 5, 2023 issued in Application No. 2022-520590.
International Search Report dated Jul. 1, 2020 issued in Application No. PCT/KR2019/013927.

* cited by examiner

【FIG. 1】
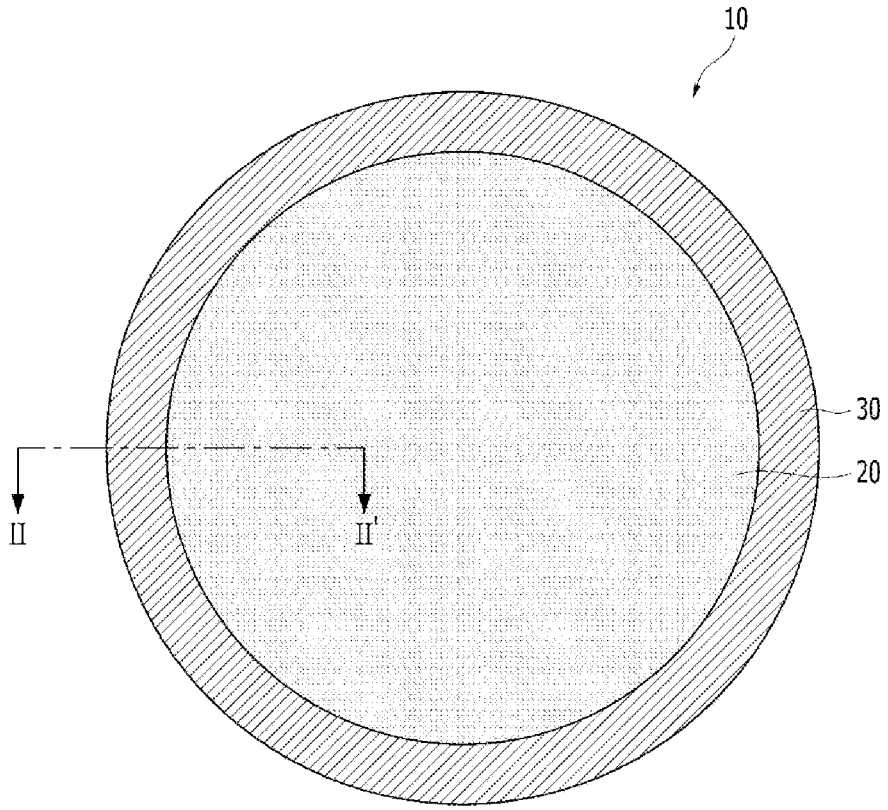

【FIG. 2A】
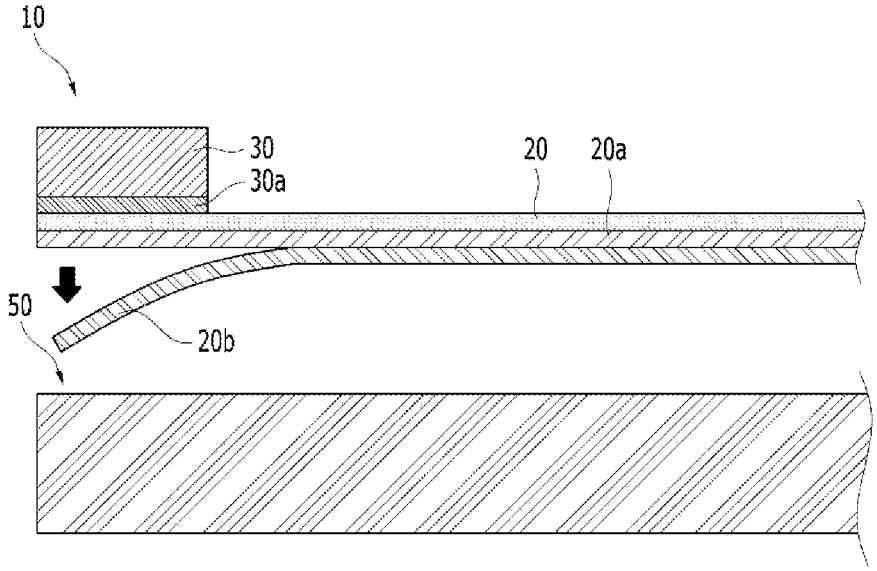

【FIG. 2B】
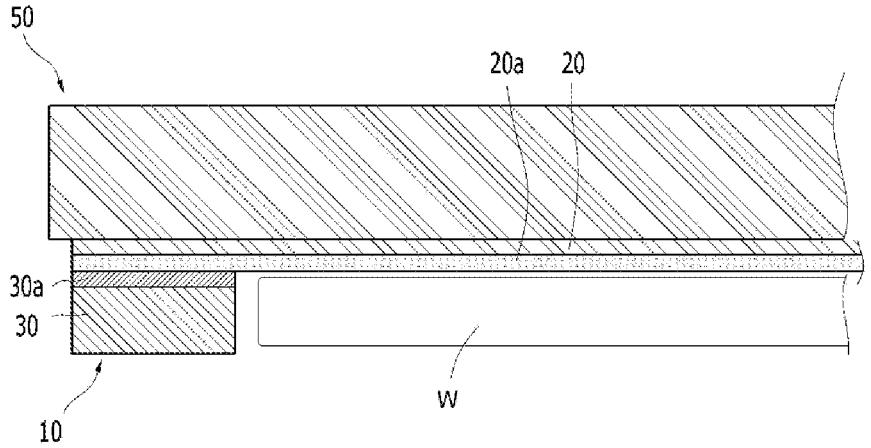

【FIG. 3】
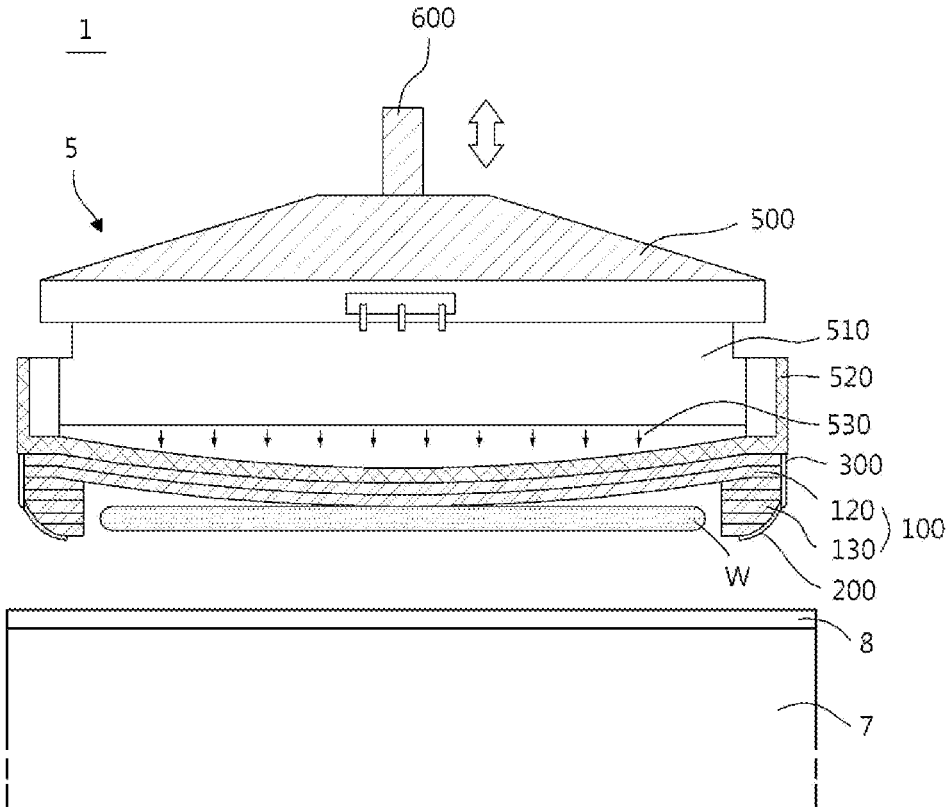

【FIG. 4A】
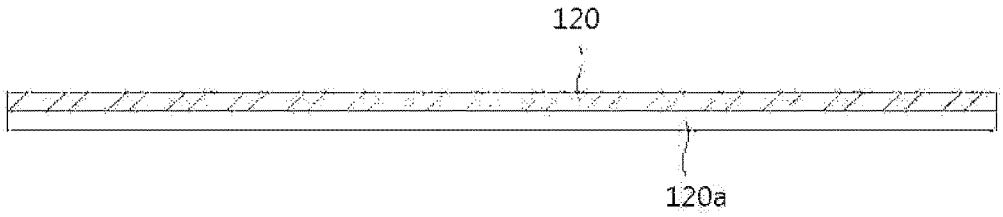
【FIG. 4B】
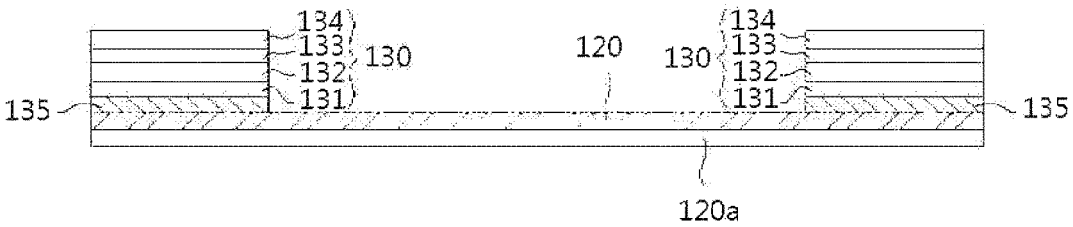

【FIG. 5A】
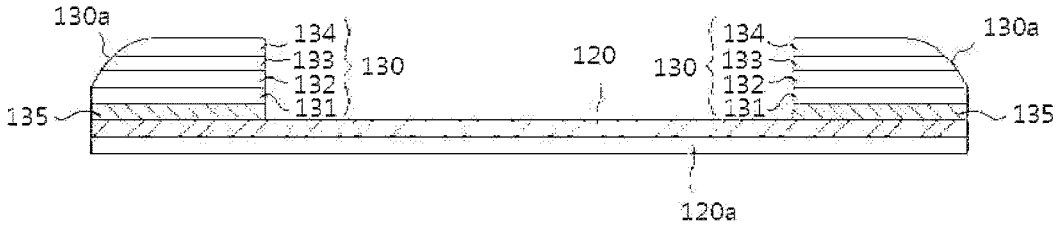
【FIG. 5B】
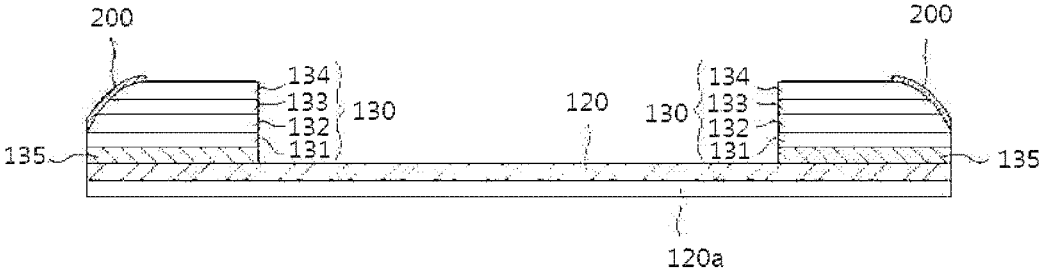

【FIG. 6A】
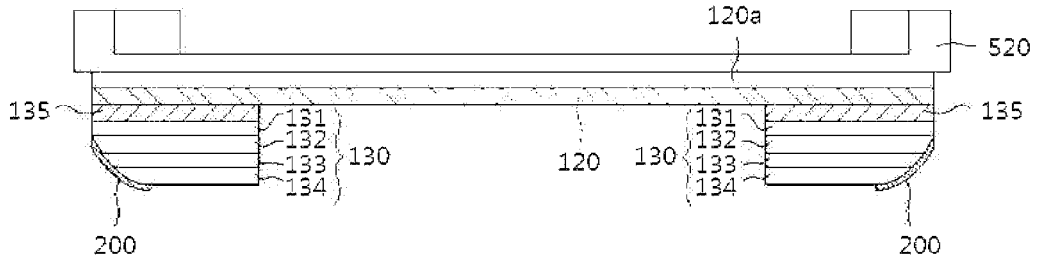
【FIG. 6B】
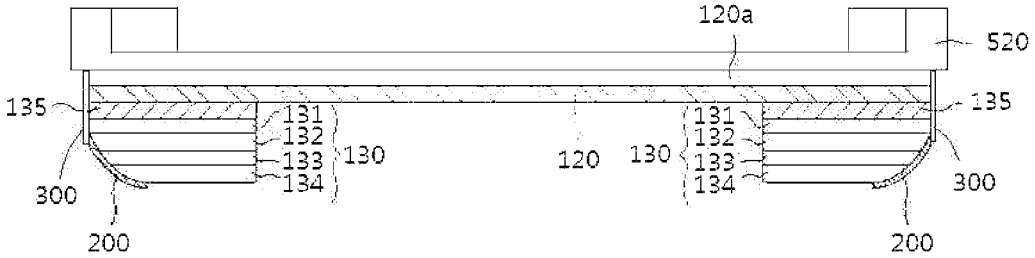

【FIG. 7】
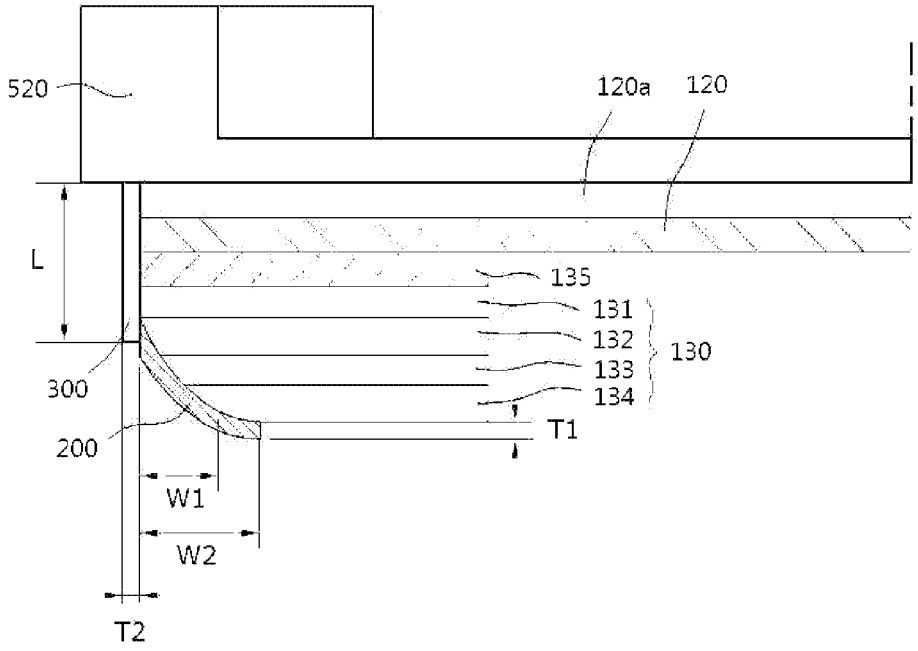

【FIG. 8A】
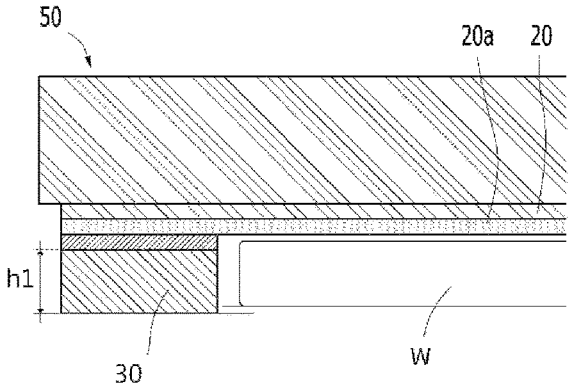
【FIG. 8B】
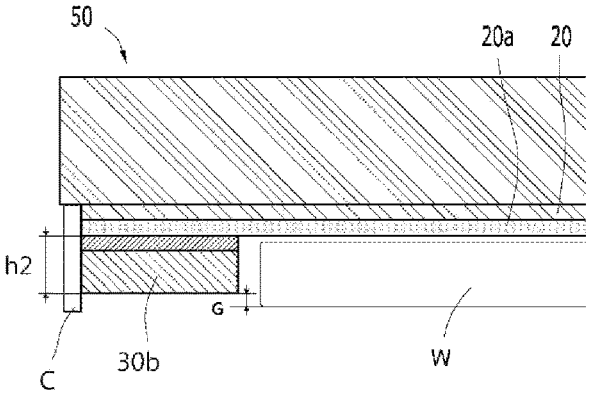

WAFER POLISHING HEAD, METHOD FOR MANUFACTURING WAFER POLISHING HEAD, AND WAFER POLISHING APPARATUS COMPRISING SAME

CROSS-REFERENCE TO RELATED PATENT APPLICATIONS

This application is a U.S. National Stage Application under 35 U.S.C. § 371 of PCT Application No. PCT/KR2019/013927, filed Oct. 23, 2019, which claims priority to Korean Patent Application No. 10-2019-0121299, filed Oct. 1, 2019, whose entire disclosures are hereby incorporated by reference.

TECHNICAL FIELD

Embodiments relate to a wafer polishing apparatus, and more particularly to a polishing head used for wafer polishing.

BACKGROUND ART

A silicon wafer manufacturing process includes a single-crystal growth process of forming a single-crystal ingot, a slicing process of slicing the single-crystal ingot to obtain a thin disc-shaped wafer, an edge grinding process of grinding an edge of the wafer obtained through the slicing process in order to prevent fracture or distortion of the wafer, a lapping process of removing damage due to mechanical machining remaining on the wafer, a polishing process of polishing the wafer, and a cleaning process of removing a polishing agent and foreign matter from the polished wafer.

Thereamong, the wafer polishing process may include several steps, such as primary polishing, secondary polishing, and tertiary polishing, and may be performed using a wafer polishing apparatus.

A general wafer polishing apparatus may include a surface plate having a polishing pad attached thereto, a polishing head configured to be rotated on the surface plate while wrapping a wafer, and a slurry spray nozzle configured to supply slurry to the polishing pad.

During the polishing process, the surface plate may be rotated about a rotary shaft thereof, and the polishing head may be rotated about a rotary shaft thereof in a state of being in tight contact with the polishing pad. At this time, the slurry supplied through the slurry spray nozzle may penetrate the wafer located in the polishing head to polish the wafer that contacts the polishing pad.

Meanwhile, a final polishing process is performed using the polishing head, which includes a rubber chuck and a template assembly attached to the rubber chuck, the template assembly being configured to fix the wafer.

FIG. 1 is a plan view of a template assembly, FIG. 2A is a sectional view taken along II-II' of FIG. 1, showing the template assembly and a rubber chuck, and FIG. 2B shows the state in which a wafer is mounted to a polishing head in which the template assembly of FIG. 1 and the rubber chuck are coupled to each other.

As shown in FIGS. 1 and 2, the template assembly 10 may include a disc-shaped film 20, which is also called a back material, and a guide ring 30 adhered to an outer circumferential portion of an upper surface of the disc-shaped film 20 via a hot-melt sheet 30*a*.

The guide ring 30 may have a circular inner circumferential surface so as to wrap the wafer W (see FIG. 2B) seated on the disc-shaped film 20. The thickness of the guide ring 30 may be adjusted by compressing multiple layers of epoxy glass.

Here, the template assembly 10, which is a consumable material, is detachably attached to the rubber chuck 50. Consequently, a double-sided adhesive 20*a* for coupling with the rubber chuck 50 is applied to a lower end of the template assembly 10, and the double-sided adhesive 20*a* is covered with release paper 20*b*.

A process of attaching the template assembly 10 is as follows. First, the rubber chuck 520 is preheated, and a surface of the rubber chuck is cleaned using methanol. Subsequently, the template assembly 10 is located at the rubber chuck 50, and the disc-shaped film 20 at which the double-sided tape 20*a* is located is attached to the rubber chuck 50 while the release paper 20*b* is gradually separated from the double-sided tape.

When the template assembly 10 is attached to the rubber chuck 50, as shown in FIG. 2B, the rubber chuck 50 is mounted to the polishing head such that the template assembly 10 is located thereunder. A wafer W is mounted inside the guide ring 30 of the template assembly 10, whereby the template assembly 10 abuts a polishing pad.

Meanwhile, during a polishing process, the wafer is polished while slurry is supplied between the polishing head and the polishing pad. However, when an adhesive layer (an adhesive) included in the rubber chuck and the template assembly elutes into the slurry due to heat generated at the time of polishing, the wafer may be contaminated, whereby flatness of the wafer may be deteriorated.

DISCLOSURE

Technical Problem

Embodiments provide a polishing pad for wafer polishing apparatuses capable of preventing an adhesive layer included in a rubber chuck and a template assembly from eluting into slurry during a polishing process, thereby improving flatness of a wafer, and a wafer polishing apparatus including the same.

Technical Solution

A wafer polishing head according to an embodiment includes a template assembly including a base substrate, a guide ring disposed at an edge of the base substrate, and an adhesive material configured to adhere the guide ring and the base substrate to each other and a second coating layer formed on an outer circumferential surface of the adhesive material and an outer circumferential surface of the guide ring.

The second coating layer may be an epoxy coating layer.

The second coating layer may include epoxy and a polymer mixed at a mass ratio of 2:1 to 4:1.

The second coating layer may have a thickness of 1 mm to 5 mm.

A wafer polishing head according to another embodiment includes a template assembly including a base substrate, a guide ring disposed at an edge of the base substrate, an adhesive material configured to adhere the guide ring and the base substrate to each other, a round surface formed on an outer side surface of the guide ring, and an adhesive applied to one surface of the base substrate, a first coating layer formed on the round surface, a rubber chuck configured to fix the base substrate and to support the template assembly, and a second coating layer formed on the adhesive and an outer circumferential surface of the adhesive material.

Each of the first and second coating layers may be an epoxy coating layer.

Each of the first and second coating layers may include epoxy and a polymer mixed at a mass ratio of 2:1 to 4:1.

The second coating layer may have a thickness equal to or less than the thickness of the first coating layer.

The second coating layer may have a thickness of 1 mm to 5 mm.

The second coating layer may have a length from the rubber chuck to the first coating layer.

A wafer polishing head manufacturing method according to an embodiment includes coupling a guide ring constituted by a plurality of layers to an edge of a base substrate, rounding an edge of the guide ring, forming a first coating layer on a round surface of the guide ring, fixing the base substrate and a rubber chuck to each other, and forming a second coating layer on an adhesive and an outer circumferential surface of an adhesive material from the rubber chuck to the first coating layer.

The second coating layer may be formed by applying and drying a material comprising epoxy and a polymer mixed at a ratio of 2:1 to 4:1.

the drying may include primary drying performed at a temperature of 45° C. or higher and secondary drying performed at room temperature.

The second coating layer may be formed by applying a material including epoxy and a polymer so as to have a thickness of 1 mm to 5 mm.

A wafer polishing apparatus according to an embodiment includes the wafer polishing head and a polishing table having a polishing pad attached thereto, the polishing table being disposed under the wafer polishing head.

Advantageous Effects

When a polishing process is performed using a wafer polishing head according to an embodiment and a wafer polishing apparatus including the same, there is no risk of an adhesive layer included in a rubber chuck and a template assembly eluting into slurry, since the adhesive layer is covered with a second coating layer, whereby it is possible to improve flatness of a wafer.

DESCRIPTION OF DRAWINGS

FIG. 1 is a plan view of a template assembly.

FIG. 2A is a sectional view taken along II-II' of FIG. 1, showing the template assembly and a rubber chuck.

FIG. 2B shows the state in which a wafer is mounted to a polishing head in which the template assembly of FIG. 1 and the rubber chuck are coupled to each other.

FIG. 3 is a view showing a wafer polishing head according to an embodiment.

FIGS. 4A to 5B sequentially show a process of manufacturing a template assembly of FIG. 3.

FIGS. 6A and 6B show a process of attaching the template assembly of FIG. 5 and a rubber chuck and coating a second coating layer.

FIG. 7 is an enlarged view of principal parts of FIG. 6.

FIGS. 8A and 8B show polishing heads having different template assemblies as comparative examples.

BEST MODE

Hereinafter, embodiments will be clearly disclosed through the description of the embodiments with reference to the accompanying drawings. In the following description of the embodiments, it will be understood that, when an element, such as a layer (film), a region, a pattern, or a structure, is referred to as being "on" or "under" another element, such as a substrate, a layer (film), a region, a pad, or a pattern, it can be "directly" on or under another element or can be "indirectly" formed such that an intervening element is also present. Terms such as "on" or "under" are described on the basis of the drawings.

In the drawings, the size of each element is exaggerated, omitted, or schematically illustrated for convenience of description and clarity. In addition, the size of each element does not entirely reflect the actual size thereof. In addition, the same reference numerals denote the same elements throughout the description of the drawings. Hereinafter, embodiments will be described with reference to the accompanying drawings.

FIG. 3 is a view showing a wafer polishing head according to an embodiment.

As shown in FIG. 3, a wafer polishing apparatus 1 according to an embodiment may generally include a wafer polishing head 5 and a polishing table 7. The polishing table 7 may be called a surface plate, and a polishing pad 8 may be mounted to an upper surface thereof.

The wafer polishing head 5 may include a body 500, a back plate 510, and a rubber chuck 520.

The body 500 forms a main body of the polishing head 5, and may be configured to be movable upwards and downwards. The body 500 is made of ceramic or stainless steel, and a pneumatic line 600, through which compressed air may be introduced, may be installed at the body. Compressed air may be introduced into the body 500 through the pneumatic line 600, whereby an expansion space 530 may be formed between the back plate 510 and the rubber chuck 520. The volume of the expansion space 530 may be changed by compressed air.

The back plate 510 is disposed under the body 500, and the rubber chuck 520 may be mounted to the back plate. The back plate 510 may be fixed to the body 500 by bolts, etc. Although not shown in detail, an air introduction channel into which compressed air may flow through the pneumatic line 600 may be formed in the back plate 510.

The rubber chuck 520 is disposed under the back plate 510, and is coupled to the back plate 510 so as to wrap an outer circumferential surface of the back plate 510. The thickness of the rubber chuck 520 is variable, and the rubber chuck may expand to press a wafer W.

The rubber chuck 520 may be made of a rubber material, and an edge of the rubber chuck 520 may be fixed by a fixing means. In addition, since an edge part of the rubber chuck 520 is unfavorable to expansion, the part of the rubber chuck 520 may be formed so as to be thinner than a central part thereof.

A template assembly 100 is mounted under the rubber chuck 520. During a polishing process, the rubber chuck 520 may expand downwards to press the template assembly 100 such that the wafer W comes into tight contact with the polishing pad 8. The template assembly 100 may fix and support the wafer W while abutting the rubber chuck 520.

The template assembly 100 may include a base substrate 120, which is also called a back material, and a guide ring 130 adhered to an outer circumferential portion of an upper surface of the base substrate 120 via a hot-melt sheet 135 (see FIG. 4).

Here, the base substrate 120 may be called a disc-shaped film. The guide ring 130 may have a circular inner circumferential surface so as to wrap the wafer W seated on the base substrate 120. The thickness of the guide ring 130 may be adjusted by compressing multiple layers of epoxy glass. Since the guide ring supports the wafer W, the guide ring may be called a support.

For reference, epoxy or an epoxy resin, which is a kind of thermoset plastic, has high resistance to water and weather change, is quickly hardened, and exhibits high adhesive force. Epoxy is used as an adhesive and for reinforced plastic, molding, and protective coating. Since epoxy does not shrink when hardened and exhibits high adhesion while having high mechanical strength, water resistance, and electrical properties, epoxy is used as a cast product, a laminate, and an adhesive.

Here, the template assembly 100, which is a consumable material, is detachably attached to the rubber chuck 520. Consequently, a double-sided adhesive 120*a* for coupling with the rubber chuck 520 may be applied to one surface of the template assembly 100. Before coupling to the rubber chuck 520, one surface of the double-sided adhesive 120*a* is attached to the template assembly 100, and the other surface of the double-sided adhesive is covered with release paper (not shown; see 20*b* of FIG. 2A). In FIG. 3, the state in which the template assembly 100, from which the release paper has been removed, is mounted to the rubber chuck 520 is shown.

As described above, the template assembly 100 is provided with an adhesive layer, such as an adhesive or an adhesive material, for adhesion between the base substrate 120 and the guide ring 130 and attachment between the base substrate 120 and the rubber chuck 520. During a wafer polishing process, the adhesive layer may elute into slurry due to contact with the slurry or under high-temperature environments, whereby the wafer may be contaminated, and therefore flatness of the wafer may be deteriorated.

Consequently, embodiments may provide a wafer polishing head including a template assembly and a rubber chuck capable of preventing the above problem and a method of manufacturing the same.

FIGS. 4 and 5 sequentially show a process of manufacturing the template assembly of FIG. 3.

Hereinafter, an embodiment of a template assembly manufacturing method will be described with reference to FIGS. 4 and 5.

First, as shown in FIG. 4(*a*), a base substrate 120 is prepared. During a wafer polishing process, the base substrate 120 serves to press a wafer W while contacting one surface of the wafer W. In order to attach a template assembly 100 to a polishing head 5, an adhesive 120*a* may be attached to a first surface of the base substrate 120. For example, a double-sided adhesive may be used as the adhesive 120*a*. Release paper (not shown) may be attached to one surface of the adhesive 120*a*.

The adhesive 120*a* may be attached to one surface of the base substrate 120, and a guide ring 130 may be attached to an outer circumferential portion of the other surface of the base substrate. The wafer W is placed on the other surface of the base substrate 120 inside the guide ring 130.

The base substrate 120 may has a disc shape so as to correspond to the shape of the wafer W. As previously described, therefore, the base substrate 120 may be called a disc-shaped film. The diameter of the base substrate 120 may be greater than the diameter of the wafer W.

Subsequently, as shown in FIG. 4(*b*), the guide ring 130 is stacked on an edge of the base substrate 120. When the wafer W is polished, the guide ring 130 serves to guide and support the wafer W in the polishing head 5. An inner circumferential surface of the guide ring 130 must have a sufficient diameter for the wafer W to be placed therein.

To this end, the guide ring 130 may be adhered to an outer circumference surface of the base substrate 120 so as to have a predetermined thickness. The guide ring 130 may have a desired thickness as the result of a plurality of layers 131, 132, 133, and 134 being stacked. For example, the guide ring 130 may be made of epoxy glass.

The guide ring 130 may be fixed to the base substrate 120 via an adhesive material 135. For example, a hot-melt sheet may be used as the adhesive material 135, which constitutes an adhesive layer.

After the guide ring 130 is adhered to the base substrate 120 via the adhesive material 135, an edge of the guide ring 130 may be rounded, as shown in FIG. 5(*a*). For example, an outer side surface of an upper layer of the guide ring 130 stacked on the base substrate 120 may be smoothly rounded (hereinafter referred to as a round surface 130*a*). Here, the outer side surface means the part of the guide ring opposite the part of the guide ring that may contact the wafer W.

Here, a rounding process of forming the round surface 130*a* at the guide ring 130 will be described in detail.

First, the outer side surface of the upper layer of the guide ring 130 is primarily polished so as to have a round shape using sandpaper. At this time, the remaining parts of the guide ring 130 excluding the part of the guide ring to be rounded may be protected using a mask (not shown).

After primary polishing, residual sand is removed through air cleaning. The rounded portion of the guide ring 130 is partially rough, and therefore the guide ring is secondarily polished by rubbing.

The edge of the guide ring 130 may be rounded through the primary polishing process, and the surface of the guide ring 130 may be smoothed through the secondary polishing process, whereby the round surface 130*a* may be completed. After the round surface 130*a* is completed, residuals may be sufficiently removed from the surface of the guide ring 130 through a cleaning process, such as DIW cleaning.

Subsequently, as shown in FIG. 5(*b*), the round surface 130*a* of the guide ring 130 may be coated (hereinafter referred to as a first coating layer 200).

The first coating layer 200 has an effect of removing a very small amount of impurities and etchant that may remain on the guide ring 130 after the primary and secondary polishing, the air cleaning, and the DIW cleaning and smoothing the rough portion of the round surface 130*a*, thereby preventing damage to the polishing pad 8.

For example, the first coating layer 200 may be mainly formed on the uppermost one of the plurality of layers of the guide ring 130. Of course, the first coating layer 200 may be formed on one or several of the plurality of layers of the guide ring 130 depending on the curvature or shape of the round surface 130*a*.

At this time, epoxy may be used as a coating material constituting the first coating layer 200. Epoxy combined at a predetermined ratio as the coating material must be applied to the round surface 130*a*, and must be hardened and dried under specific conditions. If epoxy is not combined at the predetermined ratio, the first coating layer 200 may not be hardened so as to have a predetermined level or more of hardness, and the first coating layer 200 may run down or air bubbles may be generated therein depending on a drying method.

A coating process will be described in detail.

First, a coating material is prepared. A material including epoxy and a polymer mixed at a mass ratio of 10:3 may be used as the coating material. When epoxy and a polymer are mixed at a mass ratio of 2:1 to 4:1, this mixture may be sufficiently used as the material for the first coating layer 200.

After the coating material is applied, organic matter is removed from the coating material. In this embodiment, a doped coating material is primarily dried at a temperature of 45° C. or higher, and is secondarily dried at room temperature. In the primary drying process, firing may be mainly performed, whereby organic matter may be removed from the coating material, and in the secondary drying process, the coating material may be hardened.

At this time, if drying is performed at excessively low temperatures, epoxy may not be sufficiently hardened, and if drying is performed at excessively high temperatures, short circuit in the adhesive material 135 may be caused.

As described above, the template assembly 100 according to the embodiment may be manufactured so as to include the base substrate 120, the guide ring 130 disposed at the edge of the base substrate 120, the adhesive material 135 that adheres the guide ring 130 and the base substrate 120 to each other, the round surface 130*a* formed at the outer side surface of the guide ring 130, the first coating layer 200 formed on the round surface 130 by coating, and the adhesive 120*a* applied to one surface of the base substrate 120.

FIG. 6 shows a process of attaching the template assembly of FIG. 5 and the rubber chuck and coating a second coating layer.

As shown in FIGS. 6 and 7, the template assembly 100 manufactured through the above process may be attached to the rubber chuck 520 in order to constitute the polishing head 5.

More specifically, the template assembly 100 may be coupled to the rubber chuck 520 via the adhesive 120*a* or double-sided tape applied to one surface of the base substrate 120.

As described above, the template assembly 100 is provided with the adhesive layer, such as the adhesive material 135 or the adhesive 120*a*, for adhesion between the base substrate 120 and the guide ring 130 and attachment between the base substrate 120 and the rubber chuck 520. Since the wafer polishing head 5 includes the adhesive layer, the adhesive layer may elute into slurry due to contact with the slurry or under high-temperature environments during a wafer polishing process. In this embodiment, therefore, a second coating layer 300 may be further included in order to prevent such a problem.

As shown in FIGS. 6(*b*) and 7, the second coating layer 300 may be formed so as to cover exposed portions of an outer circumferential surface of the adhesive material and an outer circumferential surface of the guide ring.

At this time, epoxy may be used as a coating material constituting the second coating layer 300. Epoxy combined at a predetermined ratio as the coating material may be applied by spraying, and may be hardened and dried under specific conditions.

The coating process is performed in the state in which the template assembly 100 and the rubber chuck 520 are coupled to each other. A material including epoxy and a polymer mixed at a mass ratio of 10:3 may be used as the coating material. When epoxy and a polymer are mixed at a mass ratio of 2:1 to 4:1, this mixture may be sufficiently used as the material for the second coating layer 300.

After the coating material is applied, organic matter may be removed from the coating material. In this embodiment, a doped coating material is primarily dried at a temperature of 45° C. or higher, and is secondarily dried at room temperature. In the primary drying process, firing may be mainly performed, whereby organic matter may be removed from the coating material, and in the secondary drying process, the coating material may be hardened.

At this time, if drying is performed at excessively low temperatures, epoxy may not be sufficiently hardened, and if drying is performed at excessively high temperatures, short circuit in the adhesive material 135 may be caused.

The first coating layer 200 is formed on the round surface 130*a* of the guide ring 130, and the second coating layer 300 may have a length L from the rubber chuck 520 to the first coating layer 200, as shown in FIG. 7. Of course, the second coating layer 300 may be minimally formed so as to prevent leakage of the adhesive layer included in the template assembly 100 and the rubber chuck 520 to the outside.

Meanwhile, the first coating layer 200 may be stacked so as to have a thickness T1 of 2 mm to 5 mm. If the thickness T1 of the first coating layer 200 is less than 2 mm, the first coating layer 200 may be damaged when the wafer W is polished. If the thickness T1 of the first coating layer 200 is greater than 5 mm, pressure at an edge part of the first coating layer is nonuniform, whereby the wafer W may be separated from the template assembly 100 when the wafer W is polished.

The width W2 of the first coating layer 200 may be greater than the width W1 of the rounded portion of the guide ring 130. That is, the first coating layer 200 must be wider in order to protect the entirety of the rounded portion of the guide ring 130.

The width W1 of the rounded portion of the guide ring 130 is about 30 mm, and the rounded portion of the guide ring may be rounded so as to have a width within an error of less than 10%. A ratio of the width W1 of rounded epoxy glass to the width W2 of the first coating layer 200 may be 1:14 to 1:16.

In addition, the first coating layer 200 is thicker outside the guide ring 130 than inside the guide ring. The reason for this is that the applied material, such as epoxy, may run down to the outside before being dried and hardened.

Meanwhile, the second coating layer 300 may have a thickness T2 of 1 mm to 5 mm. The second coating layer 300 does not contact the polishing pad 8 (see FIG. 3), unlike the first coating layer 200. Consequently, the thickness of the second coating layer may be less than the thickness T1 of the first coating layer 200.

For equilibrium with the first coating layer 200 and convenience at the time of manufacture, however, the thickness T2 of the second coating layer 300 and the thickness T1 of the first coating layer may be equal to each other.

Hereinafter, a method of manufacturing the wafer polishing head will be briefly described in brief stepwise.

First, a base substrate 120 is prepared. One surface of the base substrate 120 may be covered with an adhesive 120*a*. Subsequently, a step of coupling a guide ring 130 constituted by a plurality of layers 131, 132, 133, and 134 to an edge of the other surface of the base substrate 120 is performed.

The guide ring 130 may be attached to the base substrate 120 via an adhesive material 135. When the guide ring 130 is attached to the base substrate 120, an edge of the guide ring 130 is rounded. A round surface 130*a* is formed at an outer side surface of the guide ring 130 by rounding. The round surface 130*a* may be polished and cleaned.

Subsequently, a step of forming a first coating layer 200 on the round surface 130*a* of the guide ring 130 is performed. The first coating layer 200 may be formed by applying and drying a material including epoxy and a polymer mixed at a mass ratio of 2:1 to 4:1. The first coating layer 200 may have a thickness of 2 mm to 5 mm.

After application, the first coating layer 200 may be primarily dried at a temperature of 45° C. or higher, and may be secondarily dried at room temperature.

When a template assembly 100 is manufactured, as described above, a step of fixing the base substrate 120 of the template assembly 100 and a rubber chuck 520 to each other is performed. At this time, the template assembly 100 may be fixed to the rubber chuck 520 via the adhesive 120*a* attached to one surface of the base substrate 120.

Subsequently, a step of forming a second coating layer 300 from the rubber chuck to the first coating layer 200 such that the adhesive and an outer circumferential surface of the adhesive material are not exposed is performed.

The second coating layer 300 may be formed by applying and drying a material including epoxy and a polymer mixed at a mass ratio of 2:1 to 4:1. The thickness of the second coating layer 300 may be less than or equal to the thickness of the first coating layer 200. The second coating layer may have a thickness of 2 mm to 5 mm. After application, the second coating layer 300 may be primarily dried at a temperature of 45° C. or higher, and may be secondarily dried at room temperature.

When a polishing process is performed using the wafer polishing head according to the embodiment and the wafer polishing apparatus including the same, there is no risk of the adhesive layer included in the rubber chuck and the template assembly eluting into slurry, since the adhesive layer is covered with the second coating layer. Consequently, it is possible to improve flatness of a wafer.

Meanwhile, all types of template assemblies are not applicable to the wafer polishing head according to this embodiment and the wafer polishing apparatus including the same.

FIG. 8 shows polishing heads having different template assemblies as comparative examples.

The vertical length h1 of a guide ring 30 of the template assembly shown in FIG. 8(A) is greater than the vertical length h2 of a guide ring 30*b* of the template assembly shown in FIG. 8(B) (h1>h2).

Consequently, the guide ring 30 of the template assembly shown in FIG. 8(A) directly contacts the polishing pad 8 (see FIG. 3), whereas the guide ring 30*b* of the template assembly shown in FIG. 8(B) does not contact the polishing pad 8.

The first coating layer 200 or the second coating layer 300 applied to this embodiment is applicable to the template assembly, the guide ring 30 of which directly contacts the polishing pad 8, as shown in FIG. 8(A).

In contrast, the guide ring 30*b* of the template assembly shown in FIG. 8(B) does not contact the polishing pad 8, whereby a gap G is formed between a wafer W and the guide ring 30*b*. In the above structure, therefore, a hardware (H/W) type ring-shaped cover C is installed so as to cover an outside of the guide ring 30*b* in order to compensate for the gap G. Consequently, the present disclosure is not applicable to the above structure.

Meanwhile, although an embodiment in which, when a template assembly has a round surface and a first coating layer formed on the round surface, a second coating layer is further included has been described above, the second coating layer may also be applied to a template assembly having no round surface and no first coating layer, as needed.

The features, structures, and effects described in the above embodiments are included in at least one embodiment, but are not limited to only one embodiment. Furthermore, features, structures, and effects illustrated in each embodiment may be combined or modified in other embodiments by those skilled in the art to which the embodiments pertain. Therefore, it is to be understood that such combinations and modifications fall within the scope of the present disclosure.

INDUSTRIAL APPLICABILITY

A wafer polishing head according to an embodiment, a method of manufacturing the wafer polishing head, and a wafer polishing apparatus including the same are applicable to a semiconductor manufacturing apparatus.

The invention claimed is:

1. A wafer polishing head, comprising:

a template assembly comprising a base substrate, a guide ring disposed at an edge of the base substrate, an adhesive material configured to adhere the guide ring and the base substrate to each other, a round surface formed on an outer side surface of the guide ring, and an adhesive applied to one surface of the base substrate;

a first coating layer formed on the round surface;

a rubber chuck configured to fix the base substrate and to support the template assembly; and a second coating layer formed on the adhesive and an outer circumferential surface of the guide ring, wherein the first coating layer has a thickness of 2 mm to 5 mm, and the width of the first coating layer is greater than the width of the rounded portion of the guide ring.

2. The wafer polishing head according to claim 1, wherein each of the first and second coating layers is an epoxy coating layer.

3. The wafer polishing head according to claim 1, wherein each of the first and second coating layers comprises epoxy and a polymer mixed at a mass ratio of 2:1 to 4:1.

4. The wafer polishing head according to claim 1, wherein the second coating layer has a thickness equal to or less than a thickness of the first coating layer.

5. The wafer polishing head according to claim 4, wherein the second coating layer has a thickness of 1 mm to 5 mm.

6. The wafer polishing head according to claim 1, wherein the second coating layer has a length from the rubber chuck to the first coating layer.

7. A wafer polishing apparatus comprising:

the wafer polishing head according to claim 1; and a polishing table having a polishing pad attached thereto, the polishing table being disposed under the wafer polishing head.

8. The wafer polishing apparatus according to claim 7, wherein an edge part of the rubber chuck is thinner than a central part of the rubber chuck.

9. The wafer polishing apparatus according to claim 7, wherein each of the first and second coating layers is an epoxy coating layer.

10. The wafer polishing apparatus according to claim 7, wherein the second coating layer has a thickness equal to or less than a thickness of the first coating layer.

11. The wafer polishing head according to claim 1, wherein an edge part of the rubber chuck is thinner than a central part of the rubber chuck.

12. A wafer polishing head manufacturing method, comprising:

coupling a guide ring constituted by a plurality of layers to an edge of a base substrate;

rounding an edge of the guide ring;

forming a first coating layer on a rounded edge of the guide ring;

fixing the base substrate and a rubber chuck to each other; and forming a second coating layer on an adhesive and an outer circumferential surface of the guide ring from the rubber chuck to the first coating layer, wherein the first coating layer has a thickness of 2 mm to 5 mm, and the width of the first coating layer is greater than the width of the rounded portion of the guide ring.

13. The wafer polishing head manufacturing method according to claim 12, wherein the second coating layer is formed by applying and drying a material comprising epoxy and a polymer mixed at a ratio of 2:1 to 4:1.

14. The wafer polishing head manufacturing method according to claim 13, wherein the drying comprises primary drying performed at a temperature of 45° C. or higher and secondary drying performed at room temperature.

15. The wafer polishing head manufacturing method according to claim 12, wherein the second coating layer is formed by applying a material comprising epoxy and a polymer so as to have a thickness of 1 mm to 5 mm.

16. The wafer polishing head manufacturing method according to claim 12, wherein an edge part of the rubber chuck is thinner than a central part of the rubber chuck.

* * * * *